US009776192B2

(12) United States Patent
Ebadian et al.

(10) Patent No.: US 9,776,192 B2
(45) Date of Patent: Oct. 3, 2017

(54) COMMINUTING APPARATUS

(71) Applicant: Phiston Technologies, Inc., Miami, FL (US)

(72) Inventors: M. Ali Ebadian, Miami, FL (US); William Olliges, Palm City, FL (US)

(73) Assignee: Phiston Technologies, Inc., Miami, FL (US)

( * ) Notice: Subject to any disclaimer, the term of this patent is extended or adjusted under 35 U.S.C. 154(b) by 0 days.

(21) Appl. No.: 15/077,536

(22) Filed: Mar. 22, 2016

(65) Prior Publication Data

US 2016/0271620 A1 Sep. 22, 2016

Related U.S. Application Data

(63) Continuation-in-part of application No. 13/750,367, filed on Jan. 25, 2013, now abandoned.

(51) Int. Cl.

| | |
|---|---|
| ***B02C 25/00*** | (2006.01) |
| ***B02C 18/18*** | (2006.01) |
| ***B02C 18/22*** | (2006.01) |
| ***B02C 18/24*** | (2006.01) |
| ***B02C 18/38*** | (2006.01) |

(Continued)

(52) U.S. Cl.

CPC ..... *B02C 25/00* (2013.01); *B02C 18/18* (2013.01); *B02C 18/186* (2013.01); *B02C 18/2283* (2013.01); *B02C 18/24* (2013.01); *B02C 18/38* (2013.01); *B02C 23/16* (2013.01); *B02C 2018/0015* (2013.01); *B02C 2018/188* (2013.01); *B02C 2023/165* (2013.01)

(58) Field of Classification Search

CPC ... B02C 18/18; B02C 18/186; B02C 18/2283; B02C 18/24; B02C 18/38; B02C 25/00; B02C 23/16; B02C 2018/0015; B02C 2018/188; B02C 2023/165

USPC ..... 241/35

See application file for complete search history.

(56) References Cited

U.S. PATENT DOCUMENTS 2,222,073 A * 11/1940 Hauge ..... B02C 18/144 241/223

4,161,296 A * 7/1979 Parker ..... B02C 18/148 241/152.2

(Continued)

OTHER PUBLICATIONS

Anonymous, "Experience the peace of mind of high security data storage media destruction", Marketing pamphlet, Phiston Technologies, Inc., Company marketing file: Phitech10.042.613, Miami, Florida, (2015).

(Continued)

*Primary Examiner* — R. K. Arundale
*Assistant Examiner* — Joseph Finan, Jr.
(74) *Attorney, Agent, or Firm* — McHale & Slavin, P.A.

(57) ABSTRACT

A device for comminuting media materials that store sensitive information. The device is a rotating mill core with removable flat edged blades, a set of stacked bed knives and a screen. The mill core rotates in close proximity to adjustable bed knives to shear the material being fed before passing through a screen in order to grate the material. The mill core has an angular positioned blade constructed and arranged to shear material with said bed knives. The mill core has a mass and is operated at 1000 rpm. A flywheel is further attached to the mill core in order to conserve rotational energy and improve the efficiency of the device. Vacuum ports facilitate cleanup.

13 Claims, 12 Drawing Sheets

(51) Int. Cl.
*B02C 23/16* (2006.01)
*B02C 18/00* (2006.01)

(56) References Cited

U.S. PATENT DOCUMENTS

| | | | | |
|---|---|---|---|---|
| 5,711,492 | A * | 1/1998 | Cheladze | B02C 18/18 241/220 |
| 7,267,146 | B2 * | 9/2007 | Olofsson | B27L 11/005 144/162.1 |
| 7,267,294 | B2 | 9/2007 | Castronovo | |
| 7,270,282 | B2 | 9/2007 | Castronovo | |
| 7,324,321 | B2 | 1/2008 | Olliges | |
| 7,334,747 | B2 | 2/2008 | Castronovo | |
| 7,357,340 | B2 | 4/2008 | Castronovo | |
| 7,424,981 | B2 | 9/2008 | Castronovo | |
| 7,448,562 | B2 | 11/2008 | Castronovo | |
| 7,500,625 | B2 | 3/2009 | Castronovo | |
| 7,852,590 | B1 | 12/2010 | Olliges | |
| 8,064,183 | B2 | 11/2011 | Olliges | |
| 2001/0045478 | A1 * | 11/2001 | Recker | B02C 18/145 241/294 |
| 2003/0015818 | A1 * | 1/2003 | Magvire | B02C 18/148 264/140 |
| 2004/0112999 | A1 * | 6/2004 | Byram | B02C 13/286 241/34 |
| 2014/0299702 | A1 * | 10/2014 | Kroell | B02C 18/18 241/282.1 |
| 2015/0328642 | A1 * | 11/2015 | Shegerian | B02C 18/0007 241/30 |

OTHER PUBLICATIONS

Anonymous, "Phiston MediaDice: A patented high security optical media destroyer that disintegrates CDs, DVDs, Blu-Ray discs, and magnetic strip cards", Marketing Pamphlet, Phiston Technologies, Inc., Miami, Florida, (2015).

* cited by examiner

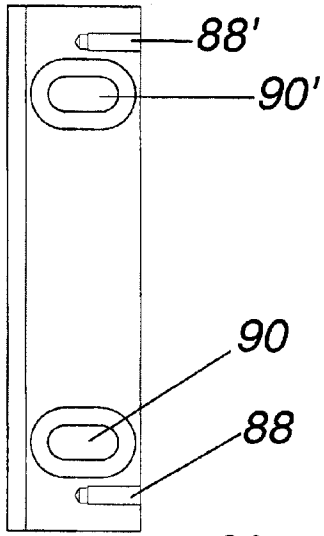
Fig. 7A
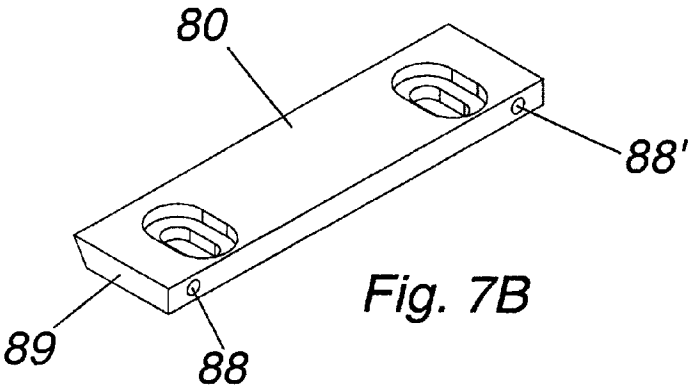
Fig. 7B
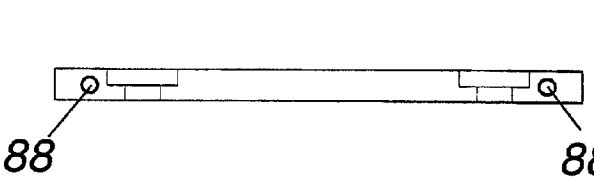
Fig. 7C
Fig. 7D

COMMINUTING APPARATUS

PRIORITY CLAIM

In accordance with 37 C.F.R. 1.76, a claim of priority is included in an Application Data Sheet filed concurrently herewith. Accordingly, the present invention claims priority as a continuation in part of U.S. patent application Ser. No. 13/750,367, entitled "COMMINUTING APPARATUS", filed Jan. 25, 2013. The contents of the above referenced application is incorporated herein by reference.

FIELD OF THE INVENTION

This invention is related to the field of sensitive material destruction and, in particular, to a apparatus for comminuting material that contains sensitive material into fine particles.

BACKGROUND OF THE INVENTION

As technology evolves, sensitive information can be stored on items that can be easily copied or stolen. For instance, security badges, licenses, credit cards, and the like provide visually identifying material that typically includes "digital" data. When such items need to be destroyed, a person can determine if the visual material is oblivated so that the sensitive visually material is unusable. Unfortunately, the condition of the digital data cannot be visually reviewed and the only way to assure the digital data is rendered unusable if for the material to be changed into a state that renders it impossible to read. For this reason it is critical that sensitive information be disposed in a manner where the information is absolutely unrecoverable.

One of the named inventors of the instant inventor has been awarded a number of patents for data destroying devices including U.S. Pat. No. 7,324,321 for a Degaussing Apparatus; U.S. Pat. No. 7,852,590 for a Solid State Memory Decommissioner; and U.S. Pat. No. 8,064,183 for a Capacitor based Bi-Directional Degaussing Apparatus. However, it is noted that the media placed on planar flat material can be literally destroyed such as when the material ground to dust. Although there are devices that can comminute materials in compliance with NSA/CSS 04-02 standards, they have many disadvantages.

U.S. Pat. No. 7,267,294 and related U.S. Pat. Nos. 7,270,282; 7,334,747; 7,424,981 and 7,448,562 by Castronovo disclose a zero tolerance cutting system for paper, CDs DVDs, Polyester, plastic cards, SMART cards, wood, and other generally planar materials. The cutting system includes a cutting blade, typically a rotary cutter, and a sacrificial plate or round bar contacting the cutting blade. The contacting portion has zero clearance during the cutting operation. A metering mechanism is also provided which is capable of metering the material at a predetermined rate to the cutting blade. A mechanism is also provided for incrementally moving the sacrificial blade towards the cutting to ensure that the zero clearance is maintained between the cutting blade and the sacrificial plate, even when the sacrificial plate begins to wear down due to usage. A rotating primary shredder is followed by a secondary shredder. Air is pumped into the device in order to ensure that the materials flow to the secondary shredder and eventually exit.

U.S. Pat. No. 7,357,340 and related U.S. Pat. No. 7,500,625 by Castronovo provides cutting action from a rotary scissor action, where one curved blade of the scissors rotates and the other is stationary. In this arrangement the feed angle and position are critical. Rubber rollers feed and position the material being fed to the cutters. Deviation of the feeding angle and position will cause the scissor blades to bind.

What is needed in the industry is a comminuting device capable of automatically grinding planer material to particles wherein digital material is unrecoverable.

SUMMARY OF THE INVENTION

Disclosed is a device to comminute media containing sensitive materials into a fine powder that is in compliance with NSA/CSS 04-02 standards. The device enables increased efficiency and reliability over the known prior art by utilizing a minimal amount of moving parts and a flywheel type weight enabling the device to grind materials in to fine particles that can be removed with a conventional vacuum cleaner, preferably a Shop Vac type cleaner. The device is designed to comminute at a rate of approximately 700 CD or DVD's per hour and can easily be adapted to handle other materials such as credit cards.

Accordingly, it is an objective of the instant invention to provide a comminuting device with a rotatable mill core that has a flywheel attached. The mill core has replaceable cutting edges. The mill core simultaneously performs shearing, grating, pumping of material to the next shearing zone and exhausting of dust through the screen.

It is a further objective of the instant invention to have a plurality of bed knife pairs to cooperate with the mill core to comminute the material through shearing.

It is yet another objective of the instant invention to feed and secure the material to be comminuted with a knurled roller that cooperates with a bed knife set.

It is a still further objective of the invention to include a screen that cooperates with the mill core in order to grate material as well as filter it through 1.6 mm diameter holes.

It is a further objective of the instant invention to include vacuum ports designed to be operated with ordinary vacuum cleaners, most preferably with Shop Vac type cleaners.

It is yet another objective of the instant invention to have an automatic feeding device that feeds the knurled roller.

It is still another objective to include a control circuit board that controls the feed and cutting rates.

It is a further objective to provide an opening on the knife mill assembly pulley that cooperates with a hex key so that jam can be manually cleared.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

BRIEF DESCRIPTION OF THE FIGURES

FIG. 7A is a top view of a bed knife.

FIG. 7B is a perspective view of a bed knife.

FIG. 7C is an end view of a bed knife.

FIG. 7D is a rear view of a bed knife.

DETAILED DESCRIPTION OF THE INVENTION

Figure 1:
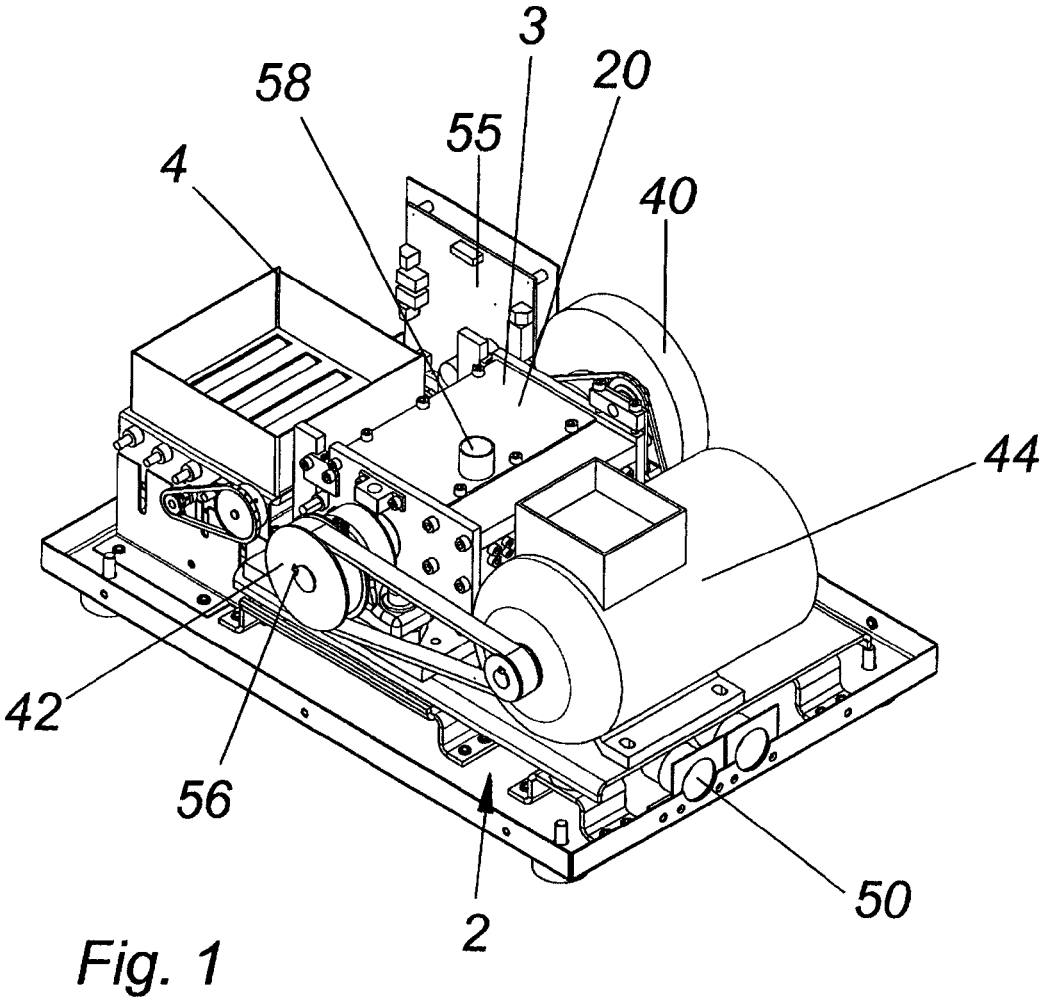
FIG. 1 is front perspective view of the present invention.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Figure 2:
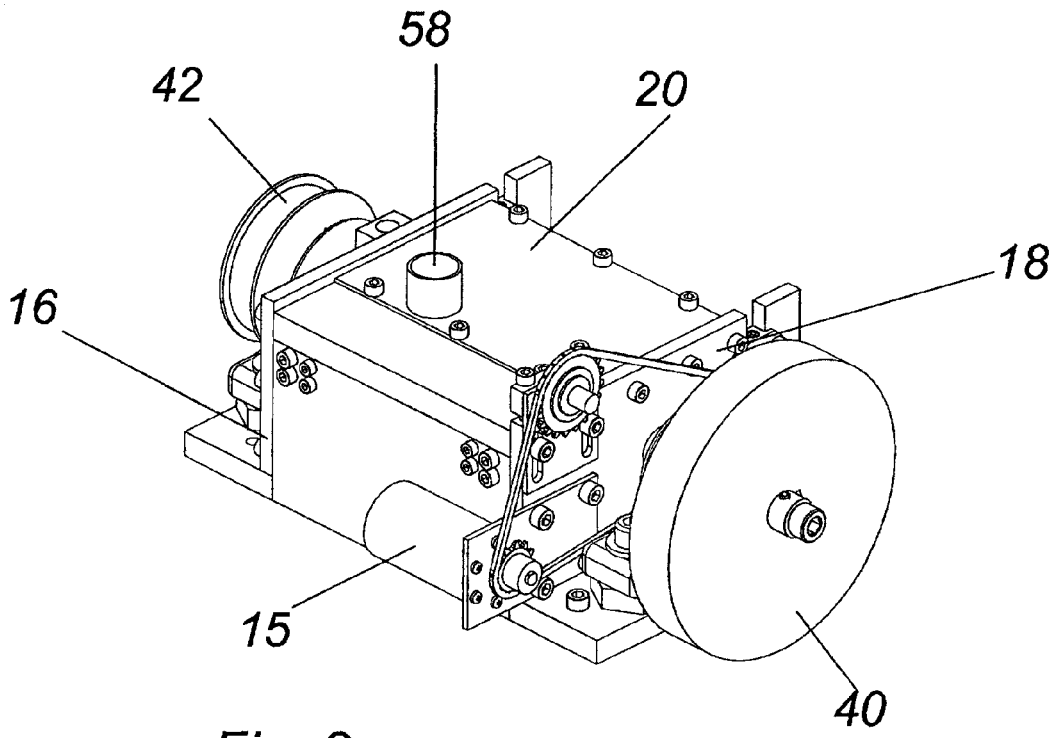
FIG. 2 is a side perspective view of the knife mill assembly.
Figure 3:
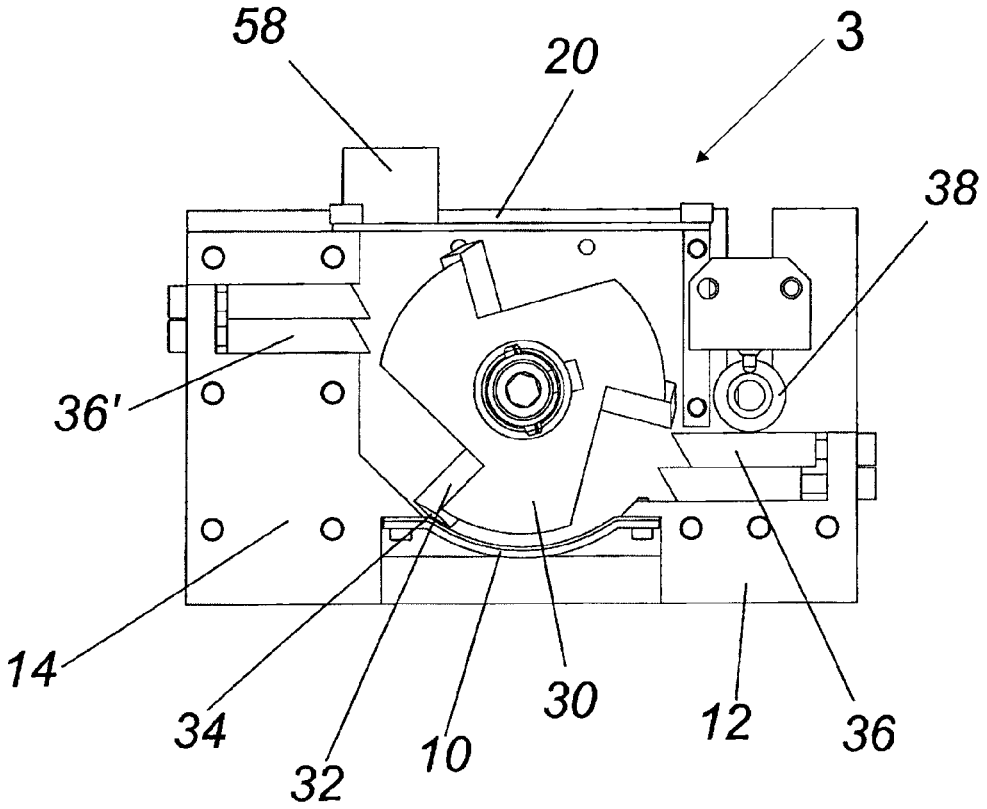
FIG. 3 is a cross sectional side view of the knife mill assembly.
Figure 4A:
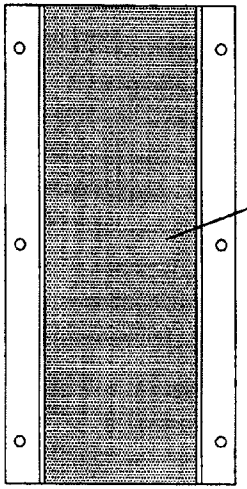
FIG. 4A is a top view of the screen.
Figure 4B:
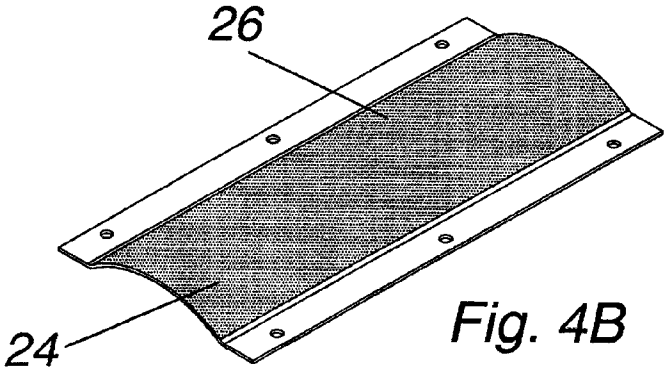
FIG. 4B is a perspective view of the screen.
Figure 4C:
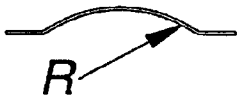
FIG. 4C is an end view of the screen.
Figure 4D:
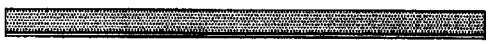
FIG. 4D is a side view of the screen.
Figure 5B:
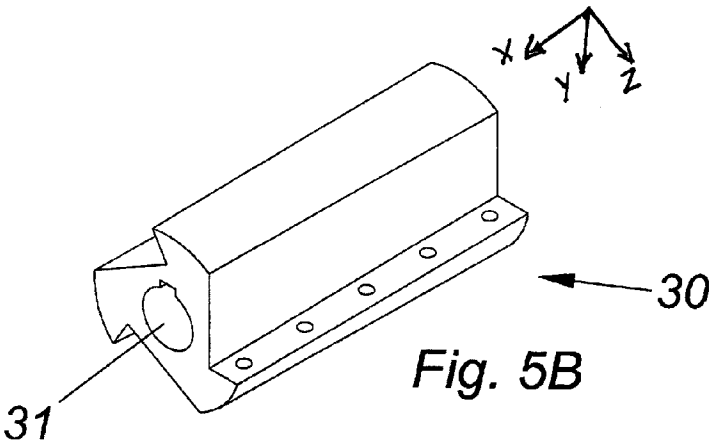
FIG. 5B is a perspective view of the mill core assembly.
Figure 5A:
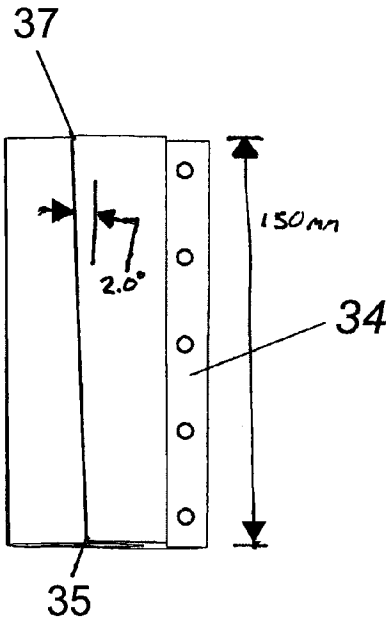
FIG. 5A is a side view of the mill core assembly.
Figure 5C:
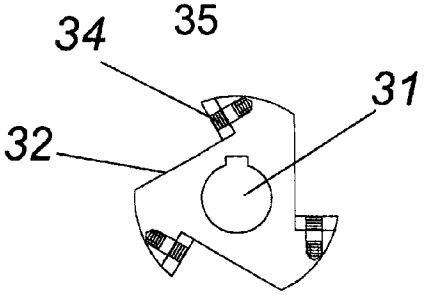
FIG. 5C is an end view of the mill core assembly.
Figure 6A:
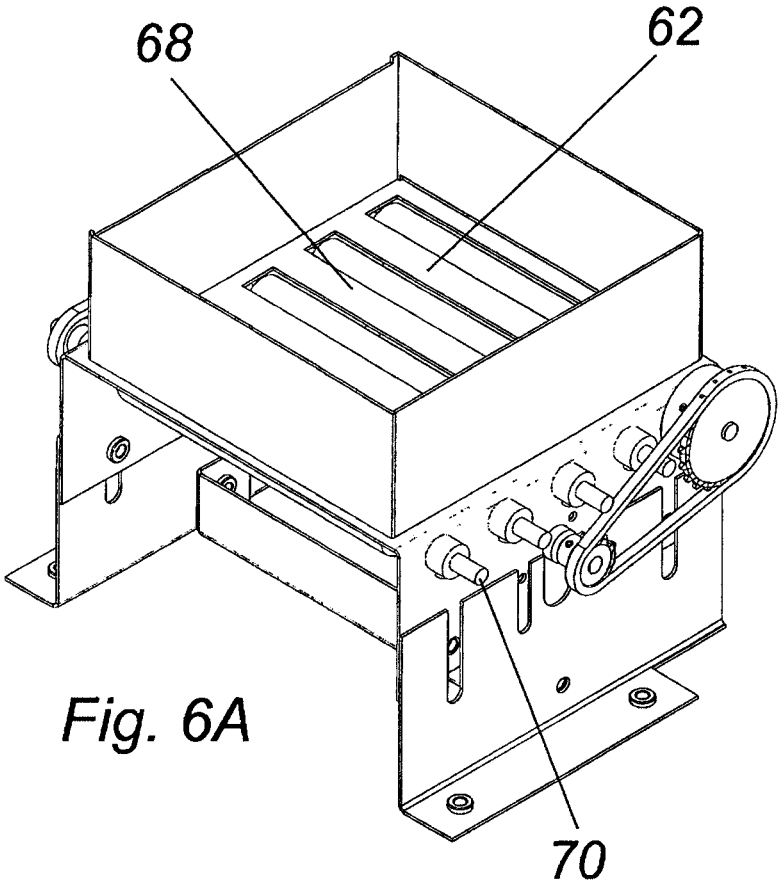
FIG. 6A is a top perspective view of the automatic feeder mechanism.
Figure 6B:
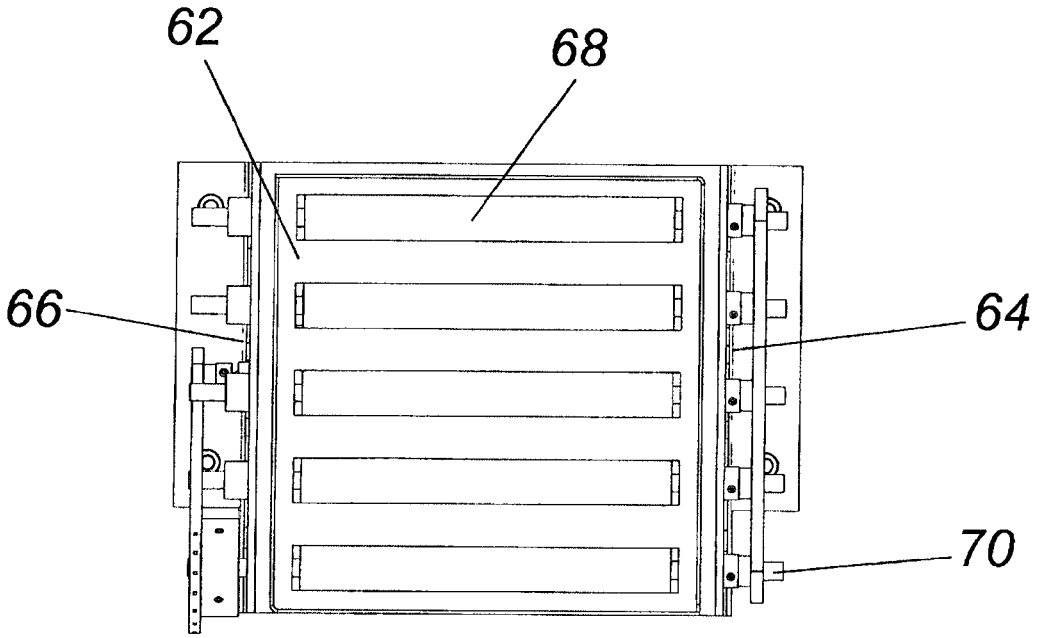
FIG. 6B is a top view of the automatic feeder mechanism.
Figure 6C:
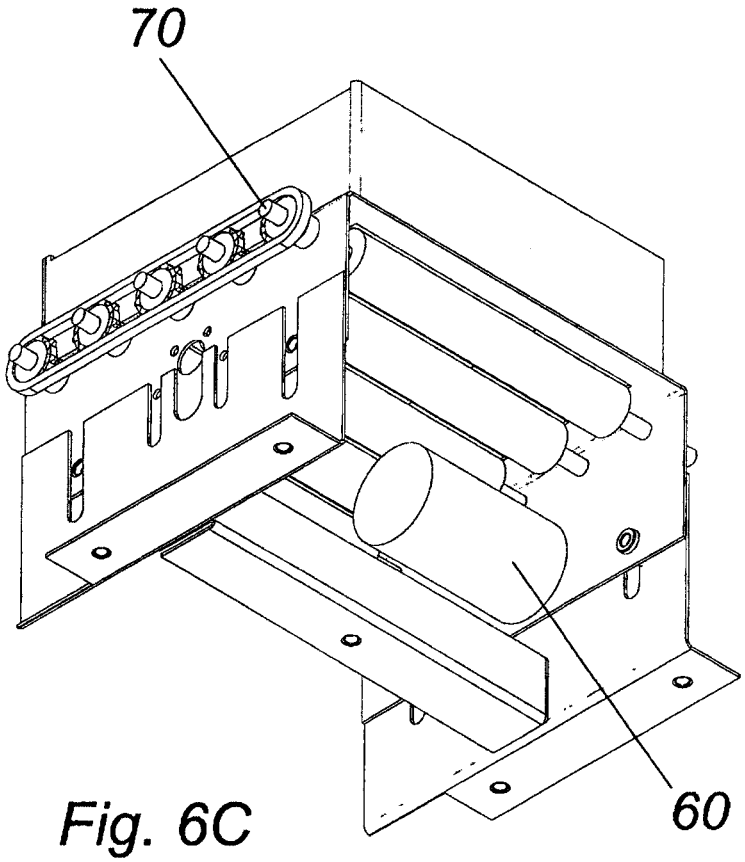
FIG. 6C is a bottom perspective view of the automatic feeder mechanism.
Figure 6D:
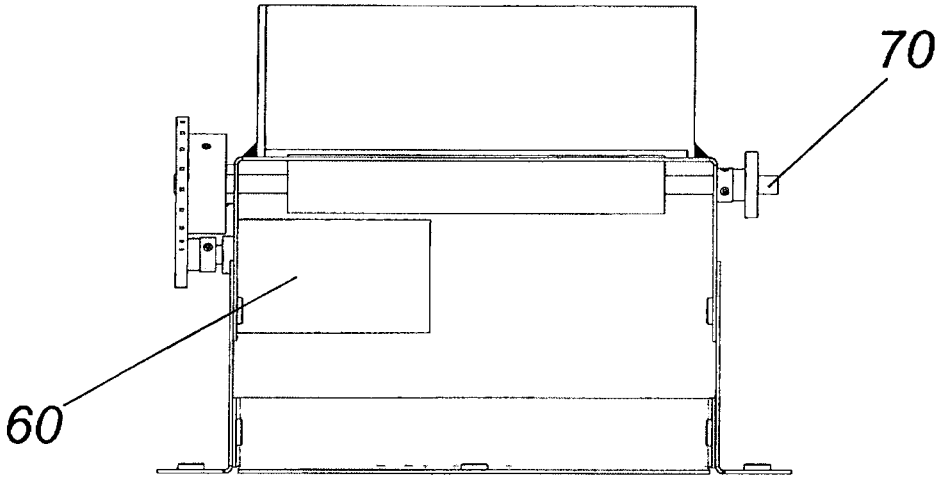
FIG. 6D is a rear view of the automatic feeder mechanism.
Figure 6E:
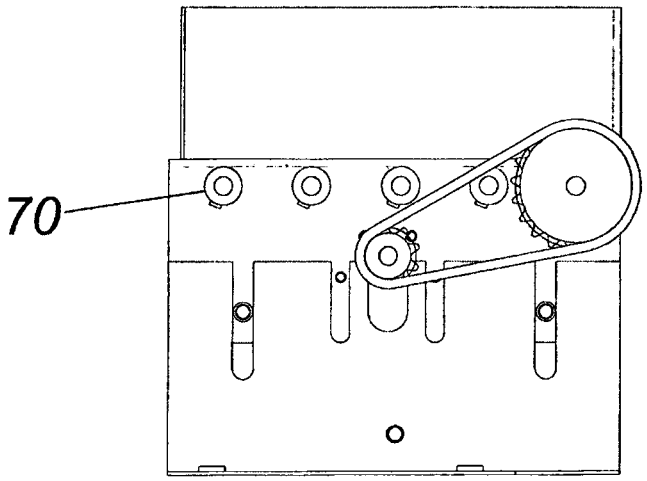
FIG. 6E is a side view of the automatic feeder mechanism.
Figure 8A:
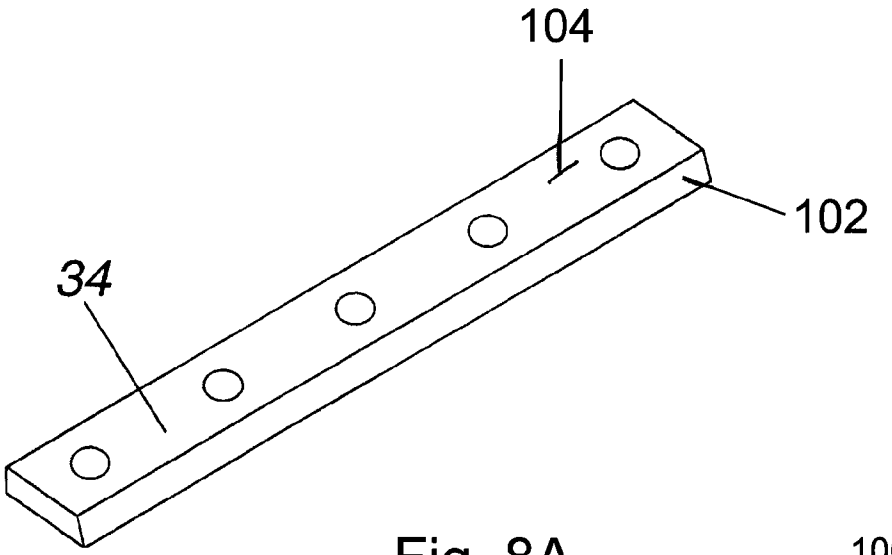
FIG. 8A is a perspective view of a cutting blade insert.
Figure 8B:
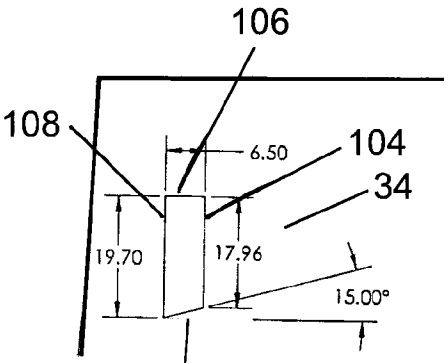
FIG. 8B is an end view of the cutting blade insert.

FIGS. 1-8, which are now referenced, with like elements numbered consistently throughout, illustrate the present invention. The device for comminuting media devices comprises a base member 2, a knife mill assembly 3 secured to said base member mounted for rotation about a fixed axis and an automatic feeding mechanism 4 secured to the base member 2.

The knife mill assembly 3 has a front wall assembly 14, a rear wall assembly 12, a left wall assembly 16, a right wall assembly 18, a top wall assembly 20 and a screen 10. The screen has a top surface 22 and a bottom surface 24 with a plurality of apertures 26 perpendicular to said top surface constructed and arranged to allow exit pass through of any comminuted material. The apertures are of a dimension of 1.6 mm with a distance between apertures of 2.4 mm. The screen is secured to and extends between the front wall 14 and the rear wall 12. The curve of the screen is of a radius R that is slightly larger than that of the rotatable mill core radius. The mill core rotates in proximity to said screen at predetermined distance whereby the rotatable mill core grates material through said screen and transports any remaining material too large to pass through the screen to the next set of said bed knives. The screen can be constructed of any suitable material but in a preferred embodiment is constructed of stainless steel. The tolerance in which the mill core rotates past the screen in a preferred embodiment is less than 1 mm.

The knife mill assembly 3 also includes a rotatable mill core 30 with a central bore 31 the length of the rotatable mill core. In a preferred embodiment, the mill core is constructed of stainless steel but could be constructed of any suitable material. The mill core is constructed and arranged to cooperate with a shaft member having a proximate and distal end. The shaft member extends through the right wall assembly 18 and the left wall assembly 16. The shaft member defines a fixed axis. The shaft member includes a fly wheel 40 fixedly attached to the distal end of the shaft in order to conserve the kinetic energy of the rotation, thereby allowing for a smaller motor to be installed. In a preferred embodiment, the fly wheel 40 weighs about 3600 grams when used with a mill core of about 4000 grams having a length of about 150 mm.

A pulley 42 is fixedly attached to the proximate end of the shaft. The rotating mill core is powered by a motor attached to the pulley 42. The rotating mill core further including at least one straight edge horizontal mill cutter bed and having at least one cutting blade 34 insert extending horizontally along substantially the entire length of said mill core placed at an angle so that a leading edge 35 of the cutting blade 34 may engage material before an offset trailing edge 37 providing a shearing of the material. In the preferred embodiment, the angle of the offset is about 2.0 degrees. In addition, the cutting blade includes a frontal surface 102 having about a 15 degree angle. A top surface 104, back surface 106 and bottom surface 108. The cutting blade insert is fixedly attached to the mill core extending axially outward. In a preferred embodiment the mill core has three mill beds and a cutting blade attached to each mill bed. The cutting blade is constructed of Si Cr steel but could be constructed of another material such as carbide steel. The mass of the mill core is about 4000 grams having a volume of about 515,500 cubic millimeters and a surface area of about 87,800 square millimeters.

The mill core has a center of mass in millimeters:

X = −46.17
Y = 2.67
Z −8.50

Principal axes of inertia and principal moments of inertia: (grams * square millimeters). Taken at the center of mass.

| | |
|---|---|
| 1x = (0.00, 0.00 1.00) | Px = 2188027.88 |
| 1y = (−0.05, −1.00, 0.00) | Py = 13809901.52 |
| 1z = (1.00, −0.05, 0.00) | Pz = 13817548.35 |

Moments of inertia: (grams * square millimeters) Taken at the center of mass and aligned with the output coordinate system.

| | | |
|---|---|---|
| Lxx = 13817529.27 | Lxy = 380.47 | Lxz = −1094.10 |
| Lyx = 380.47 | Lyy = 13809920.50 | Lyz = 54.55 |
| Lzx = −1094.10 | LZY = 54.55 | Lzz = 2188027.98 |

Moments of inertia: (grams * square millimeters)taken at the output coordinate system.

| | | |
|---|---|---|
| 1xx = 14138046.33 | 1xy = −496832.68 | 1xz = 1583548.50 |
| 1yx = −496832.68 | 1yy = 22707533.33 | 1yz = −91500.34 |
| 1zx = 1583548.50 | 1zy = −91500.34 | 1zz = 10822578.09 |

The mill core is rotated to achieve a particle size of not greater than 5 mm×5 mm that will allow destruction of material in compliance with NSA/CSS 04-02 standards. The rotation speed disintegrates discs to normal edge dimensions of 1.5 mm or less and a surface area of about 2.25 $mm^2$.

At least two bed knives 36 are installed in a stacked arrangement and fixedly attached to one of said wall assemblies. The bed knives are positioned so that blade edges extend inward towards said rotatable mill core. The mill core rotates in proximity to said bed knives in order to create shearing surfaces. In a preferred embodiment, the knife mill assembly includes two sets of stacked bed knives that are fixedly attached to opposing wall assemblies. One bed knife set 36 is positioned above the central axis of the rotatable mill core comprising two knife blades each having a blade angle of about degrees along a frontal surface 84, the position of each blade is adjustable. Also one bed knife set 36' is positioned below the central axis of the rotatable mill core also comprising two knife blades having the same adjustment ability. The bed knifes can be constructed of any suitable material such as carbide steel but is contemplated to be comprised of Si Cr steel in this embodiment. Each bed knife includes a top surface 80, a bottom surface 82, a front surface 84 having a 60 degree angle, a rear surface 86 and two side surfaces 89. The rear surface includes two apertures 88, 88' constructed and arranged to cooperate with an attachment device such as a threaded bolt. The top and bottom surface includes a plurality of elongated channels 90, 90' positioned perpendicular to the top and bottom surface for stacking the said bed knives as well as for varying the lateral position of the cutting edges with respect to the cutting blade inserts. The front surface is constructed and arranged to connect the top surface and the bottom surface at an acute angle A with respect to the horizontal plane thereby creating a cutting edge.

The knife mill assembly also includes a roller assembly 38 defined as a substantially cylindrical member rotationally mounted above the bed knife 36. The roller 38 is positioned in proximity to the top surface of the bed knife 36 so that feeder material contacts the roller surface and the top surface of the bed knife stack. In a preferred embodiment, the cylindrical roller is stainless steel and the outer surface is knurled so that the top surface of material to be comminuted is engaged and pinches the material against the bed knife surface in order to eliminate slippage. The roller is knurled in a diamond pattern with a minimum peak height of 1 mm and the threads per inch no greater than 14 TPI. The roller assembly is powered by a motor 15. The roller rotation advances material to be comminuted towards the rotatable mill core as well as securely holds the material during the first shear.

The automatic feeding mechanism includes a motor 60, a base plate 62, two side walls 64, 66 and a plurality of cylindrical members 68 extending at least partially out of said base. Each cylindrical member includes a transverse shaft member 70 fixedly attached to the side walls so that each cylindrical member is free to operate. The cylindrical members are coupled to a motor 60. The cylindrical member rotation advances material to be comminuted into said knife mill assembly roller 38. Each cylindrical member has an outer layer of high friction rubber such as neoprene.

The base member has a vacuum port assembly 50. The vacuum port assembly includes at least two openings constructed and arranged to cooperate with attachment of a vacuum hose of a Shop Vac type cleaner. One of the openings in the vacuum port assembly is constructed and arranged to cooperate with the screen so the comminuted material is vacuumed from the device. Additionally, the top wall assembly 20 includes an opening constructed 58 and arranged to cooperate with attachment of a vacuum hose. The knife mill assembly pulley includes a hex key 56 positioned parallel to said axis of rotation whereby jams can be manually cleared.

The device includes a control circuit board 55. The control circuit board includes an RPM sensor that measures the RPM's of the rotatable mill core 30. The device is designed to automatically shut off under certain conditions. The device is designed to run at approximately 750 RPM's. When the load to be destroyed is exhausted the mill core RPM's will increase and when they reached a predetermined threshold level such as 780 RPM's the machine will shut off. In the event that the machine jams, a shutdown will occur when the core slows down to approximately 700 RPM's. The control circuit board electrically connected to and therefore controls the rotatable mill core motor, the knife assembly roller motor and the feeding mechanism motor.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A device for comminuting media materials comprising:

a base member further defined by a chamber having a front wall, a rear wall, opposing side walls, a top wall assembly and a screen forming a bottom wall, said screen having a plurality of apertures constructed and arranged to allow passage of comminuted material;

a knife mill assembly secured to said base member and mounted for rotation about a fixed axis within said chamber, said knife mill assembly including a 4000 gram rotatable mill core with a central bore mounted to a shaft member having a proximate and distal end, said shaft member have a fixed axis extending through said opposing walls of said chamber with a 3600 gram fly wheel attached to said distal end and a motor attached to said proximal end, said rotating mill core further including at least one straight edge horizontal mill cutter bed having a leading edge with a 2 degree offset from a trailing edge and at least one cutting blade insert extending horizontally along substantially the entire length of said mill core, said at least one cutting blade insert fixedly attached to said mill core extending axially outward with a end of said cutting blade shaped with a 15 degree chamfer;

at least two bed knives shaped with a 60 degree chamfer are positioned in a stacked arrangement wherein one bed knife is located above the other bed knife and fixedly attached to one of said wall assemblies; said bed knives positioned so that blade edges extend inward towards said rotatable mill core; said mill core rotating in proximity to said bed knives in order to create shearing surfaces; a feeding mechanism for advancement of material to be comminuted into said knife mill assembly, said roller assembly having a substantially cylindrical member having a knurled surface rotationally mounted above said bed knife and rotated by a second motor for advancing material towards said rotatable mill core, said roller positioned in proximity to top surface of said bed knife so that feeder material contacts said roller surface and said top surface of said bed knife;

an RPM sensor to measure RPM's of said mill core;

a control circuit coupled to said RPM sensor, said control circuit regulating rotation speed of the mill core by control of said first motor and rotational speed of said feeding mechanism by control of said second motor, said control circuit maintaining the rotation speed of the mill core at about 750 rpm;

wherein said mill core rotates in proximity to said screen whereby said rotatable mill core grates material through said screen for disposal at a speed of about 1000 rpm that will allow destruction of material resulting in comminuted media material having normal edge dimensions of 1.5 mm or less.

2. The device according to claim 1, wherein said bed knife includes a top surface, a bottom surface, a front surface, a rear surface and at least two side surfaces; said rear surface including at least two apertures constructed and arranged to cooperate with an attachment device to one of said mill walls; said top and said bottom surface including a plurality of elongated channels positioned perpendicular to said top and said bottom surface for stacking a plurality of each said bed knife and varying the lateral position of said cutting edges with respect to said cutting blade inserts; said front surface constructed and arranged to connect said top surface and said bottom surface to maintain the angle of about 60 degrees with respect to the horizontal plane.

3. The device according to claim 1, wherein said knife mill assembly includes two sets of said bed knives in stacked arrangement; each said bed knife sets fixedly attached to different said wall assemblies.

4. The device according to claim 2, wherein said at least one bed knife set is positioned above the central axis of said rotatable mill core and said at least one bed knife set is positioned below the central axis of said rotatable mill core.

5. The device according to claim 1, wherein said base member includes a vacuum port assembly, said vacuum port assembly includes at least two openings constructed and arranged to cooperate with attachment of a vacuum hose.

6. The device according to claim 1, wherein said knife mill assembly includes a hex key receptacle positioned parallel to said axis of rotation whereby jams can be manually cleared by rotation of a hex key within the receptacle.

7. The device according to claim 1, wherein said top wall assembly includes at least one opening constructed and arranged to cooperate with attachment of a vacuum hose.

8. The device according to claim 1, wherein a pulley is positioned on the proximate end of said shaft and said motor employing a pulley belt for simultaneous rotation thereof.

9. The device according to claim 1 wherein said screen has a radius slightly larger than that of the rotatable mill core radius.

10. The device according to claim 1, wherein said control circuit turns off said first motor when the mill core rotation is greater than 780 RPM's.

11. The device according to claim 1 wherein said automatic feeding mechanism is defined by a base plate, two side walls and a plurality of cylindrical members each having a transverse shaft member rotatably attached to said side walls; said cylindrical members coupled to said second motor for advancement of material to be comminuted into said knife mill assembly roller.

12. The device according to claim 1, wherein said screen apertures have a dimension of about 1.6 mm with a distance between apertures of about 2.4 mm.

13. The device according to claim 1, wherein said control circuit turns off said first motor when the mill core rotation is less than 700 RPM's.

* * * * *